United States Patent [19]

Hedge

[11] Patent Number: 4,583,559

[45] Date of Patent: Apr. 22, 1986

[54] REORDERING OF TOBACCO

[75] Inventor: Roger W. Hedge, Lymington, England

[73] Assignee: British-American Tobacco Company Limited, London, England

[21] Appl. No.: 615,886

[22] Filed: May 31, 1984

[30] Foreign Application Priority Data

Jun. 10, 1983 [GB] United Kingdom ..... 8315988

[51] Int. Cl.[4] ..... A24B 3/04; A24B 3/18

[52] U.S. Cl. ..... 131/304; 131/305; 131/306

[58] Field of Search ..... 131/303–306, 131/296, 290

[56] References Cited

U.S. PATENT DOCUMENTS

| | | | |
|---|---|---|---|
| 3,974,839 | 8/1976 | Wochnowski et al. | 131/304 |
| 4,178,946 | 12/1979 | Knight | 131/304 |
| 4,235,249 | 11/1980 | Psaras et al. | 131/296 |

*Primary Examiner*—Vincent Millin
*Assistant Examiner*—H. Macey
*Attorney, Agent, or Firm*—Kane, Dalsimer, Kane, Sullivan and Kurucz

[57] ABSTRACT

A method and apparatus for reordering hot, dry expanded tobacco comprises a first reordering step in which the tobacco moisture content is raised to a first value, an intermediate cooling stage in which the tobacco is cooled to about ambient temperature (20°–25° C.) followed by a final reordering step in which the tobacco moisture content is raised to a final desired value.

9 Claims, 1 Drawing Figure

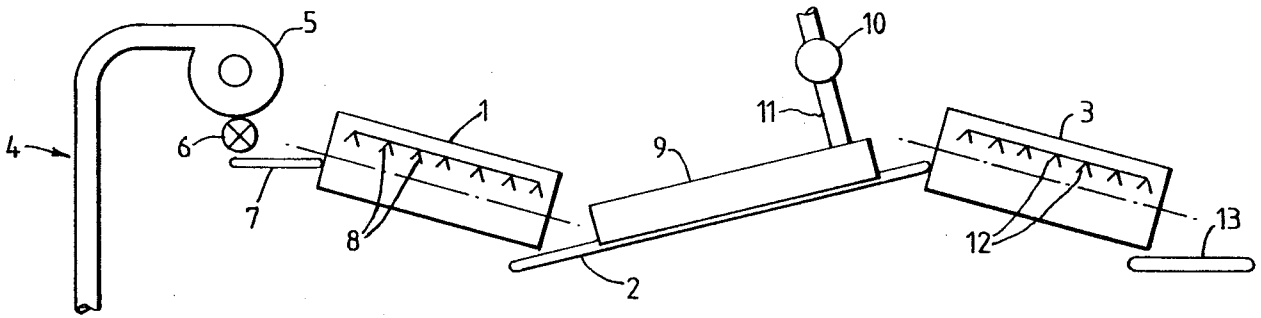
4
5
6
7
1
8
2
9
11
10
3
12
13

REORDERING OF TOBACCO

This invention relates to the reordering of hot, low moisture content, expanded tobacco, for example, cut lamina tobacco.

Tobacco expansion processes in which the tobacco is treated with an expansion agent usually have as a final process step the heating of the tobacco. As a result of the heating step the expansion agent is removed from the tobacco. At the completion of the heating step the moisture content of the expanded tobacco may be very much lower than the value which is necessary when the tobacco is fed to smoking article making machinery. The moisture content of expanded tobacco issuing from the final heating stage of an expansion plant may be in a range of 4 to 8%, whereas for cigarette making purposes, tobacco which is used as cigarette filler must have a moisture content of 12 to 15%. Thus the hot, low moisture content, expanded tobacco must be reordered to a moisture content in the 12 to 15% range before it is usable for cigarette filler purposes.

Moisture content values given herein are those to be obtained by subjecting a tobacco sample to drying in a ventilated hot air oven for 15 hours with an air temperature of 100° C., the sample being weighed before and after being dried. The moisture content values are expressed on a wet weight basis.

Two problems have heretofore been met in the reordering of hot, dry expanded tobacco. The first problem relates to the retention of the expanded state of the tobacco and the second relates to the avoidance of an undue incidence of breakage of the tobacco particles, an effect otherwise referred to as degradation.

It is an object of the present invention to provide a cost-effective and reliable method of reordering hot, dry expanded tobacco which avoids, or at least significantly reduces, the filling value reduction and particle degradation effects which have been exhibited in the use of prior reordering methods.

The present invention provides a method of reordering expanded tobacco, wherein tobacco, which as a result of having been subjected to an expansion process is hot and of low moisture content, is subjected to a first reordering step in which the moisture content thereof is raised to a first moisture content value, and the tobacco is then cooled before being subjected to a further reordering step in which the moisture content thereof is raised to a value above said first moisture content value.

The tobacco may be that which has been expanded by, for example, an expansion process which is described in United Kingdom Patent Specification No. 1,444,309. In the process of Specification No. 1,444,309 tobacco is contacted with liquid carbon dioxide, the tobacco is subjected to conditions whereby the liquid carbon dioxide therein is converted to solid carbon dioxide and the tobacco is then heated, whereby the solid carbon dioxide is vaporized.

The first moisture content value is advantageously not more than about 10 to 11% by weight. Preferably, a significant proportion of the water to be added, up to about 60% of the total water added to the tobacco in the first and further reordering steps, is added before the commencement of tobacco cooling.

The tobacco may be cooled to a temperature at or about ambient temperature, 20° C. to 25° C. for example, before being reordered to the desired final moisture content in said further reordering step. Since the tobacco is subjected to a first reordering step before a cooling step is initiated, the cooling occurs mainly by way of evaporation of water from the surface of the tobacco particles. Evaporation at this stage results in very rapid cooling. It is advantageous to carry out cooling after the first reordering step since by this means little or no degradation occurs.

It has been found that after the partially reordered tobacco has been cooled, water can be added to the tobacco without loss of filling value. As little or no loss in filling value occurs as a result of the first reordering step, overall filling value retention is of a high order.

Another advantage of an intermediate cooling step is that a final moisture content value can be readily attained to close limits when further water is applied to the tobacco. This follows the fact that since the tobacco is cool, the problem of a partial evaporation of the water by transfer of heat from the tobacco is avoided.

Although the inventive reordering method may be carried out batchwise, it is preferably carried out as a continuous flow process.

The invention also provides apparatus for carrying out the method. Apparatus suitable for use in carrying out the invention will now be described by way of example, with reference to the accompanying diagrammatic drawing.

The apparatus comprises a rotary cylinder 1, a conveyor 2 and a second rotary cylinder 3. Reference numeral 4 generally designates a heating unit of a tobacco expansion plant from which tobacco is fed to the first rotary cylinder via a centrifugal separator 5 and air airlock 6. The plant may, for example, operate in accordance with the expansion process the subject of the above mentioned Specification No. 1,444,309.

In operation of the expansion plant, tobacco is conveyed, in a stream of hot, humid air, upwardly through the heating unit 4. The centrifugal separator 5 serves to separate the air and the tobacco. The tobacco flows from the separator 5 via the rotary airlock device 6. At this stage the tobacco is hot and relatively dry, having a temperature in the range of, for example, 90° C. to 150° C. and a moisture content in the range of, for example 4% to 8%.

The tobacco issuing from the separator 6 is fed by a conveyor 7 to the inlet of the first cylinder 1. Since the tobacco is, owing to its low moisture content, brittle, it is appropriate that the conveyor 7 is of a short length. For the same reason it is preferable that the cylinder 1 is fitted with no or only a few tobacco cascading flights. As the tobacco passes along the downwardly inclined rotary cylinder 1 it is contacted by droplets of water sprayed from an array of stationary nozzles 8. In this manner the moisture content of the tobacco is raised in cylinder 1 to a value in the region of, for example, 10 or 11%. At such moisture content the tobacco particles are pliant and thus the tobacco is susceptible to only negligible degradation from subsequent mechanical handling.

The conveyor 2, which receives the tobacco as it issues from the outlet of the cylinder 1, is a vibratory conveyor and is fitted with a hood 9. Ambient air, or cooled and/or dried air, is drawn upwardly through the bed of tobacco on the conveyor 2 under the action of an induction fan 10 which is in communication with the interior of the hood 9 via a duct 11. Thus, as the tobacco is fed from the cylinder 1 up to the inlet of the second cylinder 3, it is cooled by the induced air flow. Without such cooling, a further wetting of the tobacco would cause a substantial reduction in the filling value of the tobacco.

The cylinder 3 is equipped with nozzles 12 by means of which water is sprayed onto the tobacco as it passes along the cylinder. The cylinder 3 is preferably fitted with tobacco cascading flights extending for substantially the full length of the cylinder. The flights (not shown) promote uniformity of tobacco flow through the cylinder as well as uniformity of moisture content of the tobacco. When the tobacco issues from the outlet of the cylinder 3 onto a receiving conveyor 13, it has a moisture content in the region of, for example, 12 to 15% and is thus suitable for cigarette making purposes.

An alternative apparatus suitable for use in carrying out the invention can take the form of a single rotary cylinder comprising a first reordering zone, an intermediate cooling zone and a final reordering zone. Water application means are provided in the initial and final reordering zones. The intermediate cooling zone and the final reordering zone of the cylinder preferably include tobacco cascading flights. The initial reordering zone is preferably not flighted.

What is claimed is:

1. A method of reordering expanded tobacco, wherein tobacco, which as a result of having been subjected to an expansion process is hot and of low moisture content, is subjected to a first reordering step in which the water moisture content thereof is raised to a first moisture content value, and the tobacco is then cooled before being subjected to a further reordering step in which the moisture content thereof is raised to a value above said first moisture content value.

2. A method as claimed in claim 1 wherein the first moisture content is not more than 11% by weight.

3. A method as claimed in claim 1 wherein water is added in a first and a further reordering step and up to 60% of the total water added to the tobacco in the first and further reordering step is added before the commencement of tobacco cooling.

4. A method as claimed in claim 1 wherein the tobacco is cooled to 20°-25° C. before being subjected to said further reordering step.

5. A method as claimed in claim 1 carried out as a continuous flow process.

6. Apparatus for reordering expanded tobacco including a first rotary cylinder, a second rotary cylinder, means to feed hot expanded tobacco to said first rotary cylinder, means for applying moisture to tobacco in said first rotary cylinder to carry out said first reordering step, means for receiving tobacco from the first rotary cylinder, means for cooling the tobacco and conveying means to convey cooled tobacco to the second rotary cylinder, and means for supplying moisture to tobacco in said second rotary cylinder to raise the moisture content of the tobacco to a predetermined value.

7. Apparatus according to claim 6 where said rotary cylinders each have an inlet and an outlet and support means for supporting the cylinder in an inclined position with the inlet higher than the outlet.

8. Apparatus according to claim 7 wherein tobacco cascading flights are located in the second rotary cylinder.

9. Apparatus as claimed in claim 8 wherein the cooling zone and the final reordering zone include tobacco cascading flights.

* * * * *